US005577448A

United States Patent [19]

Leung

[11] Patent Number: 5,577,448

[45] Date of Patent: Nov. 26, 1996

[54] TOY MONORAIL SYSTEM WITH SUPPORT APPARATUS

[75] Inventor: Yuk T. G. Leung, Kowloon, Hong Kong

[73] Assignee: Roxca Industries, Ltd., Kowloon, Hong Kong

[21] Appl. No.: 360,277

[22] Filed: Dec. 21, 1994

[51] Int. Cl.[6] ..... A63G 31/00

[52] U.S. Cl. ..... 104/53; 104/55; 104/125; 104/126; 238/10 R; 238/10 A

[58] Field of Search ..... 248/218.4, 219.2, 248/230.5, 219.1; 104/53, 55, 56, 63, 69, 118, 119, 120, 126; 238/10 R, 10 A, 10 E, 10 F; 211/107, 196, 205; 105/141, 144, 145

[56] References Cited

U.S. PATENT DOCUMENTS

| | | | |
|---|---|---|---|
| 563,004 | 6/1896 | Ames | 211/107 |
| 2,040,415 | 5/1936 | Trottier | 211/107 |
| 3,426,703 | 2/1969 | Morris | 104/120 |
| 4,217,727 | 8/1980 | Fetty et al. | 104/120 |
| 4,632,038 | 12/1986 | Lawrence | 104/120 |
| 4,953,785 | 9/1990 | Keska | 238/10 A |
| 5,131,618 | 7/1992 | Chapin | 238/10 R |
| 5,211,366 | 5/1993 | Cummings | 104/56 |

FOREIGN PATENT DOCUMENTS

| | | | |
|---|---|---|---|
| 3121565 | 12/1982 | Germany | 104/53 |
| 0001676 | 6/1871 | United Kingdom | 238/10 R |
| 2068754 | 8/1981 | United Kingdom | 238/10 E |

*Primary Examiner*—Mark T. Le
*Attorney, Agent, or Firm*—Morrisson Law Firm

[57] ABSTRACT

A toy monorail system supports a shuttle craft chassis with a figurine attached. An electric motor picks up power from wire contacts for propelling the chassis along the monorail track. The shuttle craft is readily placed on and lifted from the monorail track. Stable positioning of the shuttle craft chassis is assured by a pair of guidebars and guide wheels extended from the body of the chassis against the rear side of the monorail. The track is supported by four one-piece bracing arms. The bracing arms slide into positioning recesses of a two-piece central mounting clamp which is supported alternately by a base or other support member.

9 Claims, 11 Drawing Sheets

TOY MONORAIL SYSTEM WITH SUPPORT APPARATUS

BACKGROUND OF THE INVENTION

The present invention relates to toy monorail systems and apparatus. More particularly, the present invention relates to a toy monorail system and incorporated support apparatus having at least one shuttle craft with a figurine attached and an on board electric motor for propelling the chassis along the monorail track.

Many toy systems are known among conventional disclosures which employ elements to model, at miniature scale, the operation of cars, buses, and trains. Toy trains are particularly well-known and are generally mounted on tracks having two rails, much like their large scale counterparts.

U.S. Pat. No. 5,211,366 discloses a wheeled toy train unit which is disposed upon a track cantilevered above the floor, and requires a central support member (Christmas Tree) to balance. Similarly, U.S. Pat. No. 5,131,618 shows a moving model train on a track which must be attached to a Christmas Tree for support. However, provisions for achievement of stable positioning or operation of the moving vehicles are not included in these disclosures.

U.S. Pat. No. 5,279,871 also features a vertically extending tree member for attachment and support. This patent, entitled ACTION ORNAMENT WITH CHRISTMAS TREE MOUNTING THEREFOR uses a height differential between first and second track ends to fuel a ski-slope arrangement.

The prior art additionally shows a large number of principally ornamental devices, which are designed for their decorative appeal. These devices are problematic in the difficulty involved with attachment or movement of involved joints when the preferred displays are set up. These disclosures are not designed to move and thus take no steps for preventing sliding or detachment or movement.

Thus the longstanding need for continually operative, yet ornamentally functional types of toy systems is not solved within the pertinent art. Neither of the above categories of known toys provide for adequate system stability or include vehicles which are easily attached and detached to enable long-term and continuous operation.

Clearly, attempts have been made to solve these problems using known toy systems which have not adequately addressed the issues resolved by the present invention.

OBJECTS AND SUMMARY OF THE INVENTION

Accordingly, it is an object of the present invention to provide a toy monorail system and support apparatus which overcomes the drawbacks of the prior art.

It is another object of the present invention to provide a monorail track which is elevated above floor level yet does not require an independent vertical support member.

It is a further object of the present invention to provide a toy monorail system and incorporated support apparatus having at least one shuttle craft chassis with a figurine attached and an on board electric motor powered through metal wire contacts embedded in the monorail track.

It is a still further object of the present invention to provide a toy monorail system and incorporated support apparatus for achievement of stable positioning and continual operation of the at least one shuttle craft chassis with a figurine attached.

It is yet a still further object of the present invention to provide a toy monorail system and incorporated support apparatus to prevent sliding, detachment or movement of the joints when a preferred display is set up.

Briefly stated, there is provided a toy monorail system which supports a shuttle craft chassis with a figurine attached. An electric motor picks up power from wire contacts for propelling the chassis along the monorail track. The shuttle craft is readily placed on and lifted from the monorail track. Stable positioning of the shuttle craft chassis is assured by a pair of guidebars and guide wheels extended from the body of the chassis against the rear side of the monorail. The track is supported by four one-piece bracing arms. The bracing arms slide into positioning recesses of a two-piece central mounting clamp which is supported alternately by a base or other support member.

According to an embodiment of the invention, there is provided an apparatus which comprises: at least one toy shuttle craft, a monorail track, with means on the monorail track for detachably supporting the at least one toy shuttle craft, means for supporting the monorail track, which track includes a vertical rise and a plurality of guide bars, at least one driven wheel on the shuttle craft, means on the monorail track for engaging the at least one driven wheel, the at least one driven wheel being fittable on a first side of the vertical rise, at least one guide wheel on the shuttle craft, and the at least one guide wheel engaging a vertical portion of the vertical rise, whereby the shuttle craft is prevented from tilting off the monorail track.

According to a further embodiment of the invention, there is provided a toy monorail system with support apparatus comprising; at least one shuttle craft, a monorail track defining an endless travel path, the track further comprising at least fore: segments joined end to end, means for supporting the monorail track at a distance above a surface, means for mounting said shuttle craft detachedly upon said monorail, the shuttle craft embodying power drive means for driving said shuttle craft along the monorail track, and, the at least one shuttle craft chassis having a figurine fixedly attached thereto.

According to a still further embodiment of the invention, there is provided a toy monorail system with support apparatus comprising, at least one shuttle craft, a monorail track defining an endless travel path, means for supporting the monorail track at a distance above the ground, means for mounting the shuttle craft detachedly upon said monorail, the shuttle craft embodying power drive means for driving said shuttle craft along said monorail track and, the at least one shuttle craft chassis having a figurine fixedly attached thereto.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
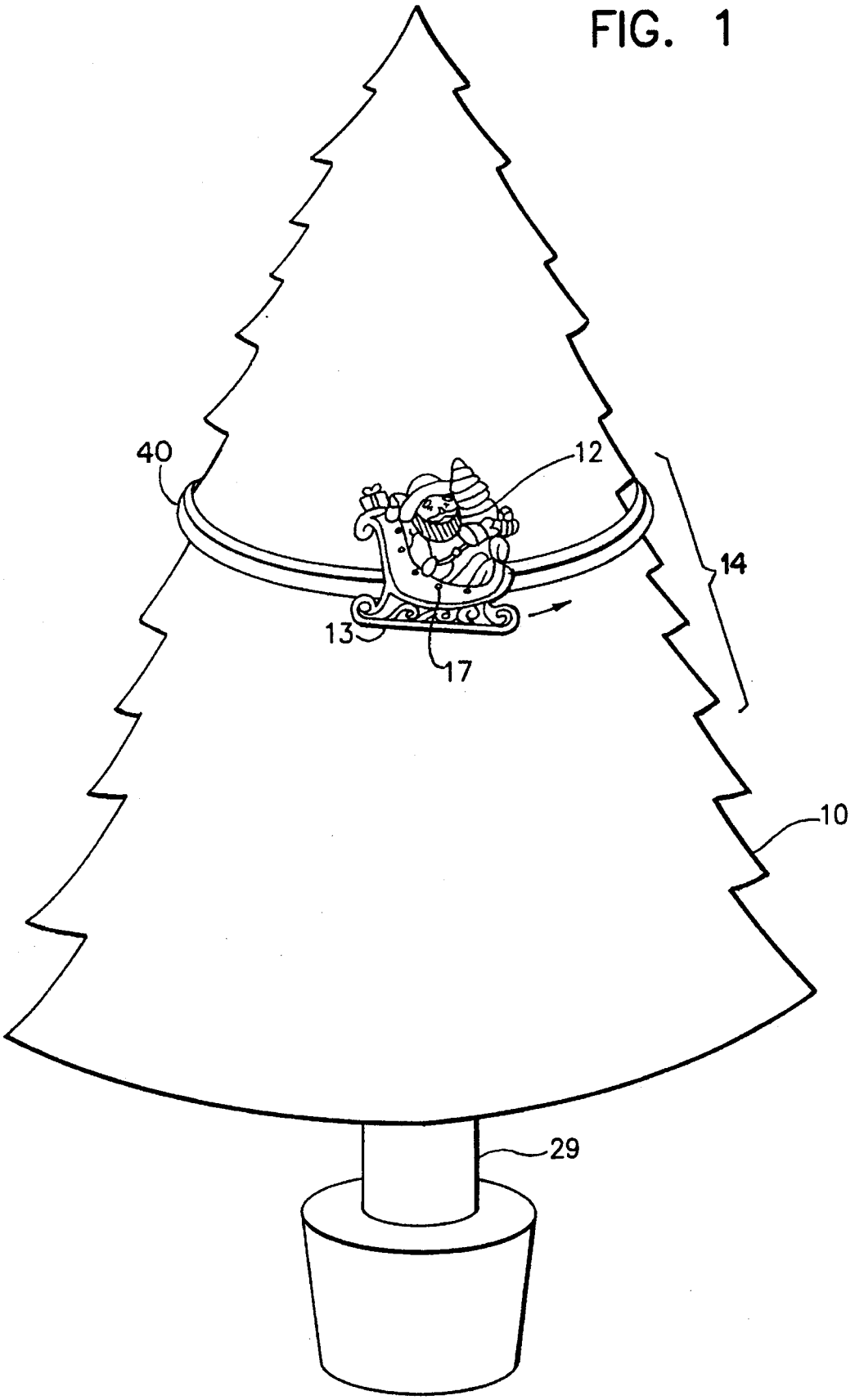
FIG. 1 is a simple perspective view showing an embodiment of the present invention mounted on a Christmas tree with a figurine attached.

Referring to FIG. 1, a monorail track 40 is shown disposed outside of the perimeter of a set of branches 14 of a Christmas Tree 10 having a tree trunk 29. A figurine 12 is fixedly attached to a shuttle craft 13 (not fully shown in this view as it is covered by the figurine 12). The figurine 12 travels around the monorail track 40 in the direction of travel indicated by the arrows.

A plurality of lights, 17 are located on shuttle craft 13. These lights are controlled by a light controller, and lighted in sequence with a multiplicity of seasonal tunes, and independently of same, depending upon the desires of the user. Actuation of the lights is controlled by the light controller located within the shuttle craft 13 (not shown in FIG. 1).

Figure 2:
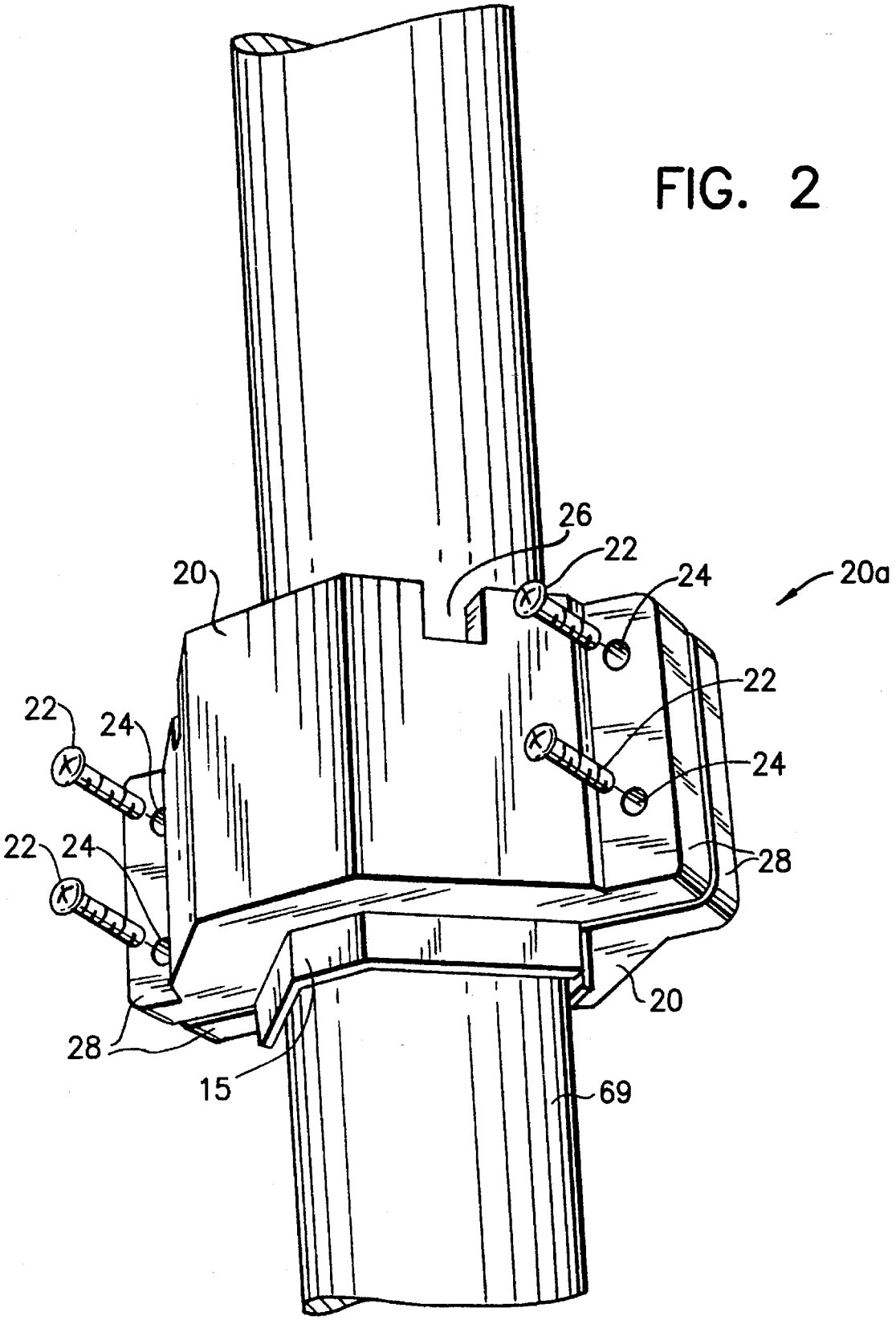
FIG. 2 is a partial perspective view of a hexagonal clamp for supporting an embodiment of the present invention.
Figure 2A:
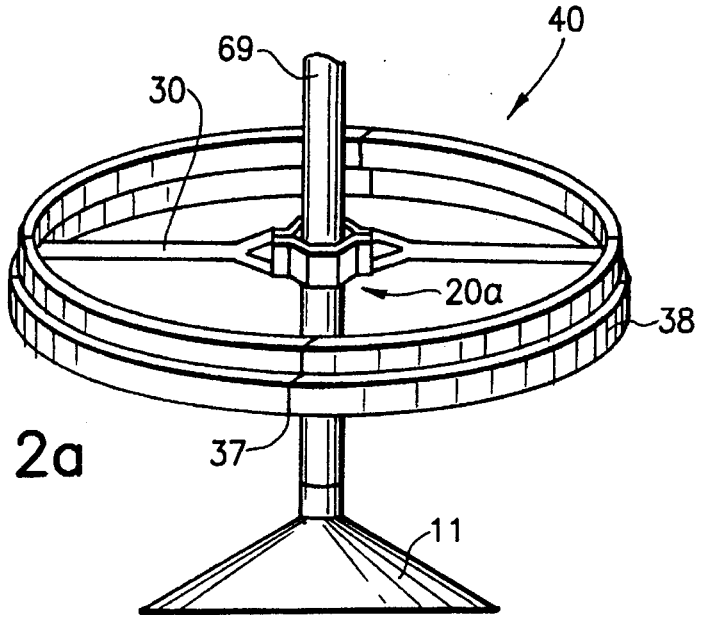
FIG. 2*a* is a simple perspective view showing an embodiment of a monorail track according to the present invention.

Referring to FIG. 2*a*, the monorail track 40 is shown forming a completed ring around a vertical support member 69 supported by a base 11. A hexagonal clamp **20*a* is clamped about vertical support member 69. Clamp 20*a* engagingly receives a bracing arm 30 at each of four apertures (not shown) extending outward to firmly support the monorail track 40**.

The monorail track 40, consists of four segments 38 fitting together end to end at a joint 37 between each adjacent pair of the segments 38. The base 11, and the vertical support member 69, enable the monorail track 40 to be supported above the surface upon which base 11 is supported.

Referring to FIG. 2, hexagonal clamp **20*a*, consists of two identical half-clamps 20 of molded plastic or metal. Each half-clamp 20 includes two extensions or flaps 28 which, when fitted to vertical support member 69, extend perpendicularly to vertical support member 69. A ridge 15 is disposed at a lower end of each half-clamp 20. The flaps 28 are bolted together along their straight long ends to clamp to the vertical support member 69. When flaps 28 are bolted together, the hexagonal clamp 20** forms a generally octagonal cross-sectional.

Each flap 28 has two holes 24, alignable with similar holes 24 in its adjacent flap 28. A screw 22 is inserted into each of the two aligned pairs of holes 24 to secure the hexagonal clamp 20 to the vertical support member 69. Screws 22 may be secured in any manner using, for example, a nut (not shown) on a distal end thereof. In the preferred embodiment, however, one of each pair of aligned holes 24 is internally threaded to receive its screw 22 (threads are not shown). In the most preferred embodiment, one of each pair of holes 24 is properly sized to receive screw 22 such that screw 22, when first twisted into hole 24, cuts threads therein. In this latter case, screws 22 are preferably of the "self-tapping" variety, especially adapted for cutting their own screw threads.

Figure 3:
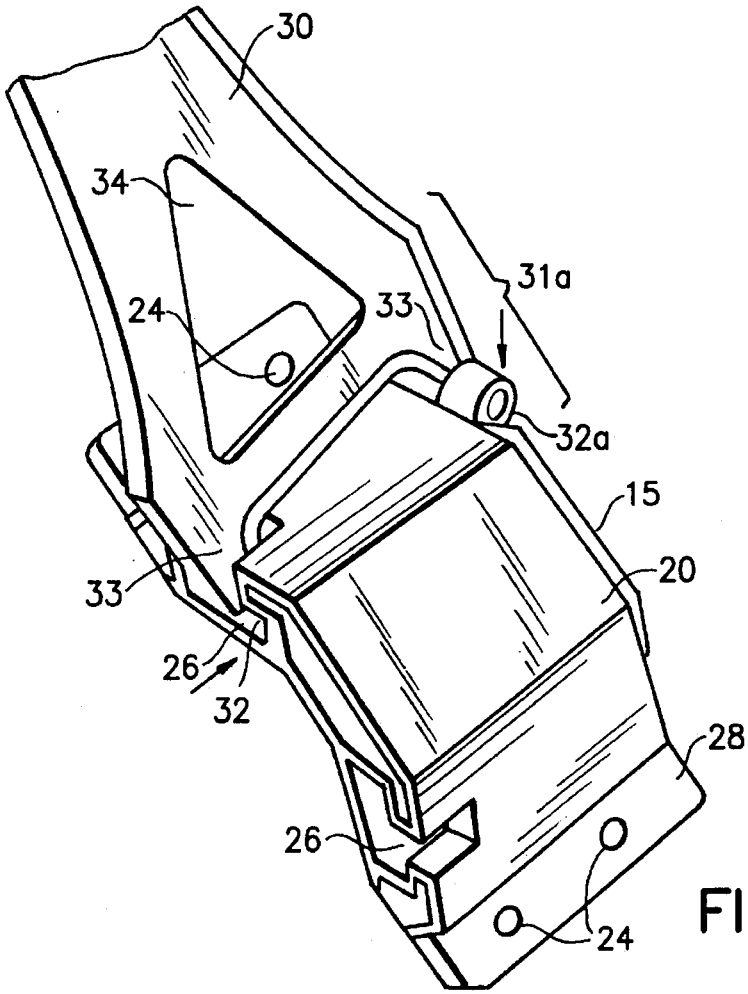
FIG. 3 is partial perspective view of a second end of a bracing arm and one piece of the hexagonal clamp showing the manner in which the second ends of the bracing arm are coupled thereto according to the present invention.

Referring to FIG. 3, each half-clamp 20 includes two T-shaped recesses 26. The bracing arm 30 consists of a single piece of molded plastic or metal having a first end 31 and a second end **31*a* which is divided into bifurcated split ends 33**.

Each bracing arm 30 is a generally Y-beam shaped having split ends 33 at the second end **31*a*. Split ends 33 are linked together forming a hollowed triangular shape aperture 34 on the second end 31*a* of bracing arm 30. Aperture 34 saves on material, and may be omitted. Each of the two split ends 33, located at the second end 31*a*, of the bracing arm 30, includes lateral protrusions 32 and 32*a*** to form a generally a general "T" shape.

The upper T-shaped lateral protrusion 32 is fitted in a corresponding T-shaped recess 26 on the upper part of the hexagonal clamp 20. The lower T-shaped lateral protrusion **32*a* is rotated downward to press against the ridge 15, which bears its weight. By this process, the bracing arm 30 is fixedly clipped onto the bottom of the hexagonal clamp 20. This locks the bracing arm 30 at the T-shaped recess 26 on the hexagonal clamp 20, and against ridge 15**.

Figure 4:
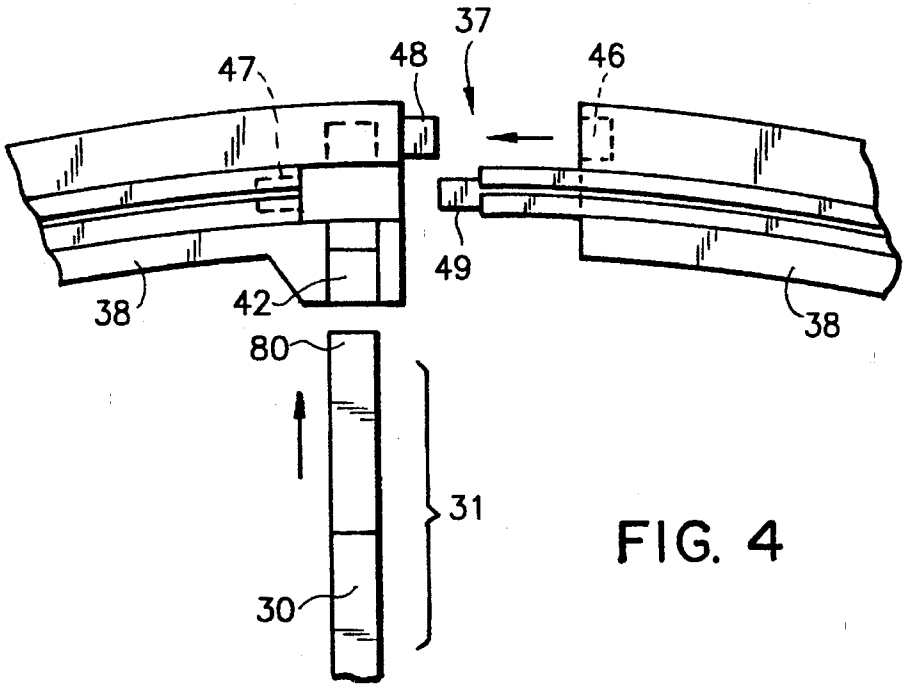
FIG. 4 is a partial fragmentary cross-sectional top view showing mutually received pairs of pegs and apertures along the inside of the monorail track sections and a third pair of peg and aperture perpendicular thereto for connecting the outer end of the bracing arm to the monorail track the present invention.

Referring to FIG. 4, a right end of a segment 38 is fitted to a left end of its adjacent segment 38. For convenience, the segment 38 on the left is identified as the left segment, and the segment 38 on the right is identified as the right segment.

When the left segment is brought into mating engagement with the right segment, a peg 48, extending from the left segment, fits into a first horizontal aperture 46 in an end of the right segment. In addition, a second peg 49, extending from said right segment, fits into a second horizontal aperture 47 in said left segment. The interfitting of pegs 48 and 49 with their respective horizontal apertures 46 and 47 provides a stable connection between the facing ends of the left and right segments, provided that forces tending to pull the ends apart are resisted.

A male connector 80, at the first end 31 of bracing arm 30 locks the left and right segments together to resist horizontal separation of the two segments 38 in the direction of the monorail track 40.

Figure 5:
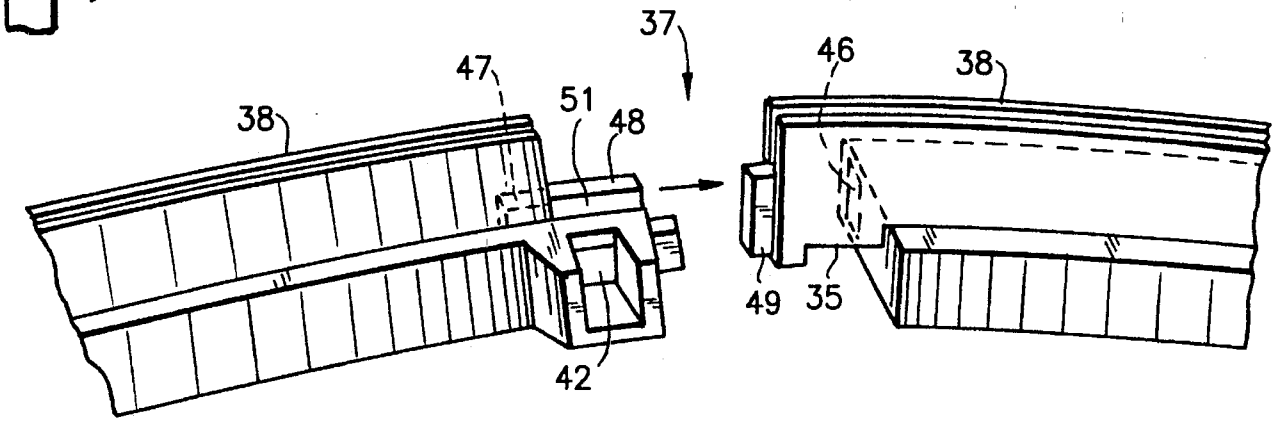
FIG. 5 is a partial perspective view of the inside of the monorail track, showing two pieces of monorail track segment being connected end to end and showing details for coupling of the two according to an embodiment of the present invention.

Referring to FIG. 5 the joint 37 between two segments 38 to be joined end to end include the first peg 48 of segment 38 received by the first horizontal aperture 46. The second peg 49 is received by second horizontal aperture 47. A notch 35, to the right of the second peg 49 is positioned to align with female connector 42.

Figure 6:
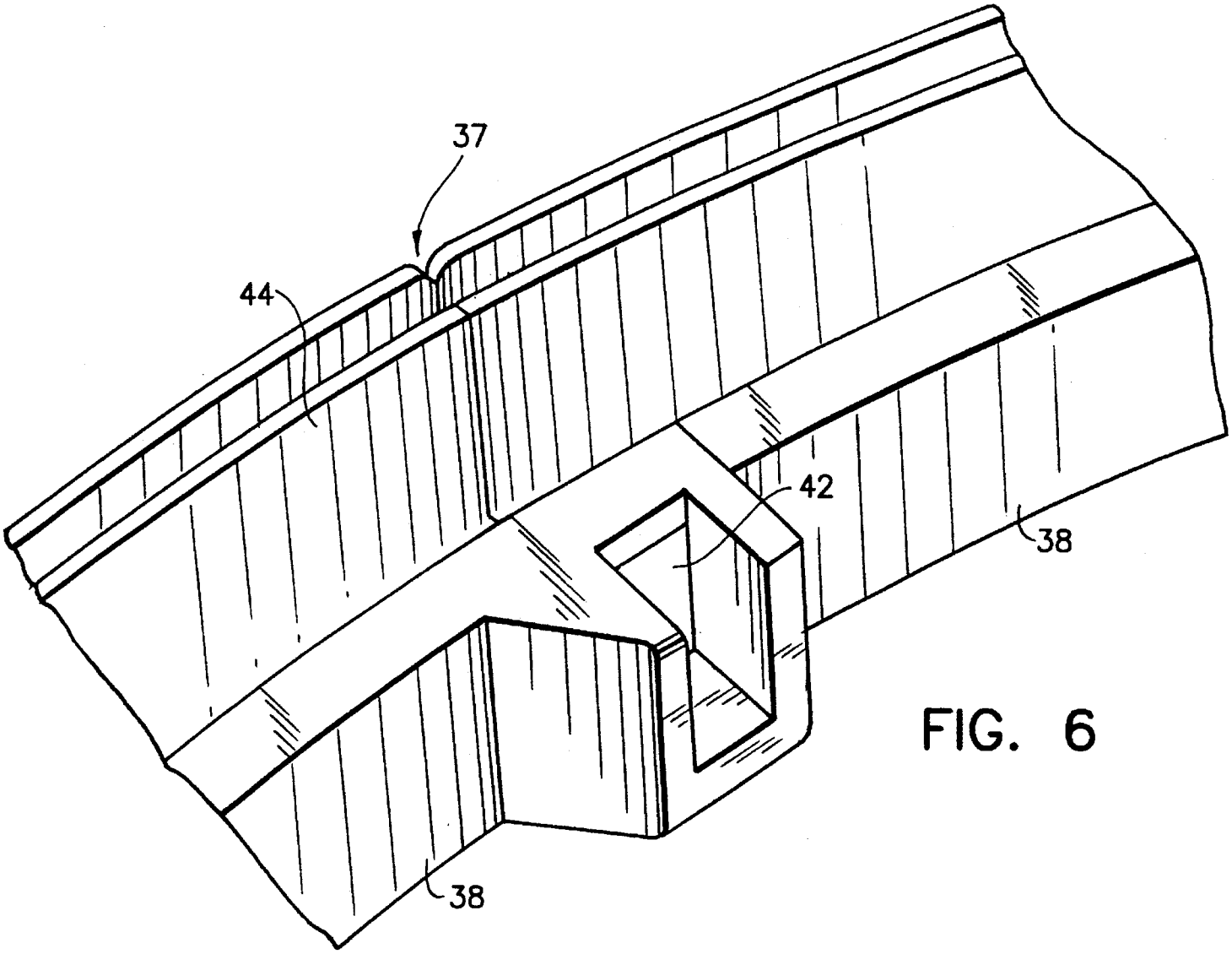
FIG. 6 is a detailed partial perspective view of a joint between two segments of monorail track segments connected end to end showing a female connector according to an embodiment of the present invention.

Referring to FIG. 6, a detailed view of the inside of the monorail track 40 shows the two segments 38 butted end to end. A vertical rise 44 runs continuously from first segment 38 to second segment 38. Joint 37 lies directly in front of a female connector 42, which is designed to receive the male connector 80 of the bracing arm 30 (not shown).

Figure 7:
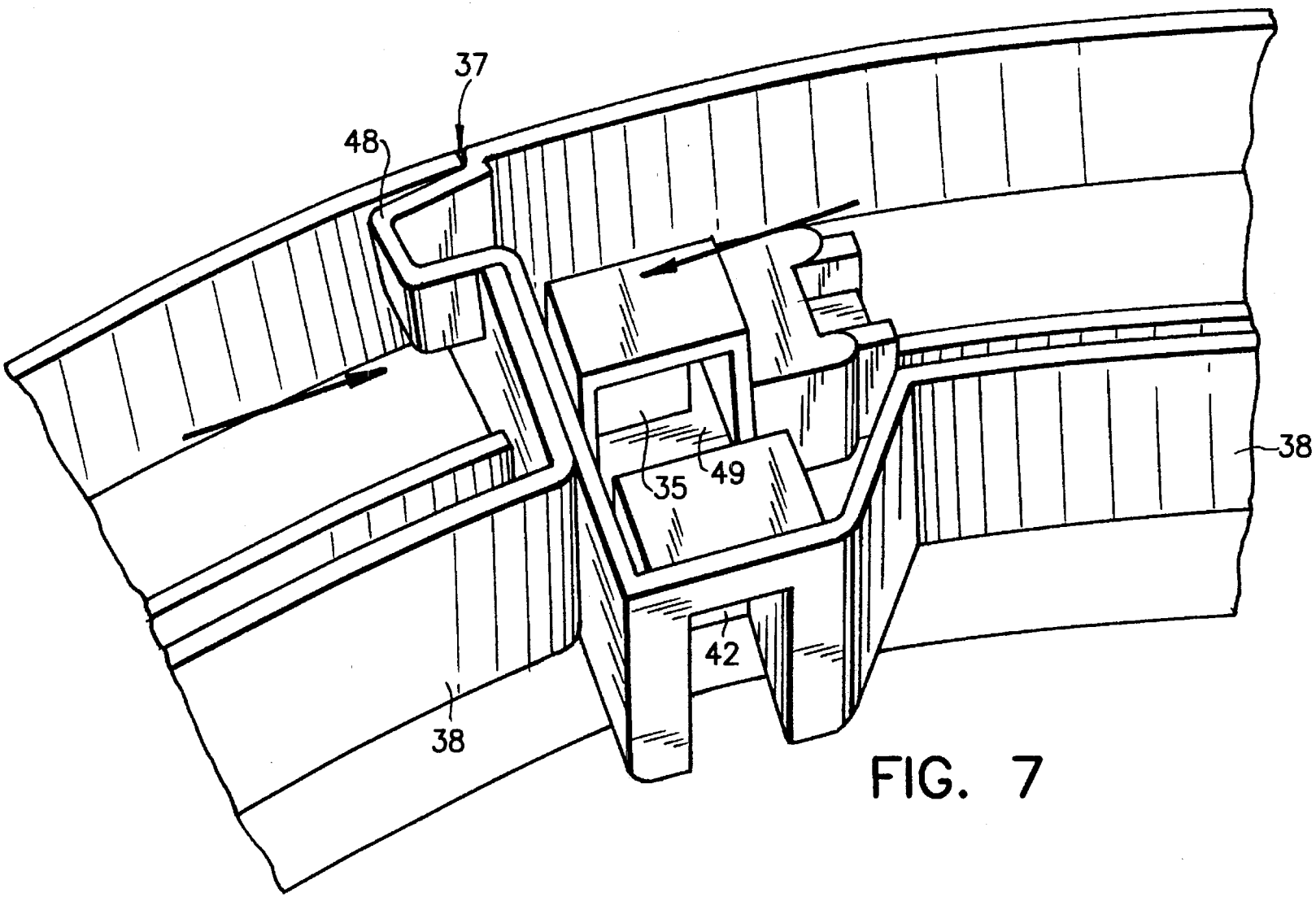
FIG. 7 is a fragmentary perspective view from underneath of the joint area between two monorail track segments showing the details of an inner aperture of the female connector according the present invention.

Referring now to FIG. 7, an underneath view of joining of segments 38 end to end, reveals that the joint 37 is the mutual connection point of the first and the second pegs 48 and 49, with their respective apertures. The first peg 48 of segment 38 is shown lodged within the first horizontal aperture 46. The second peg 49 is shown lodged within the second horizontal aperture 47. A notch 35, integral with the second peg 49 locks into slot 51 (as shown in FIG. 5).

Figure 8:
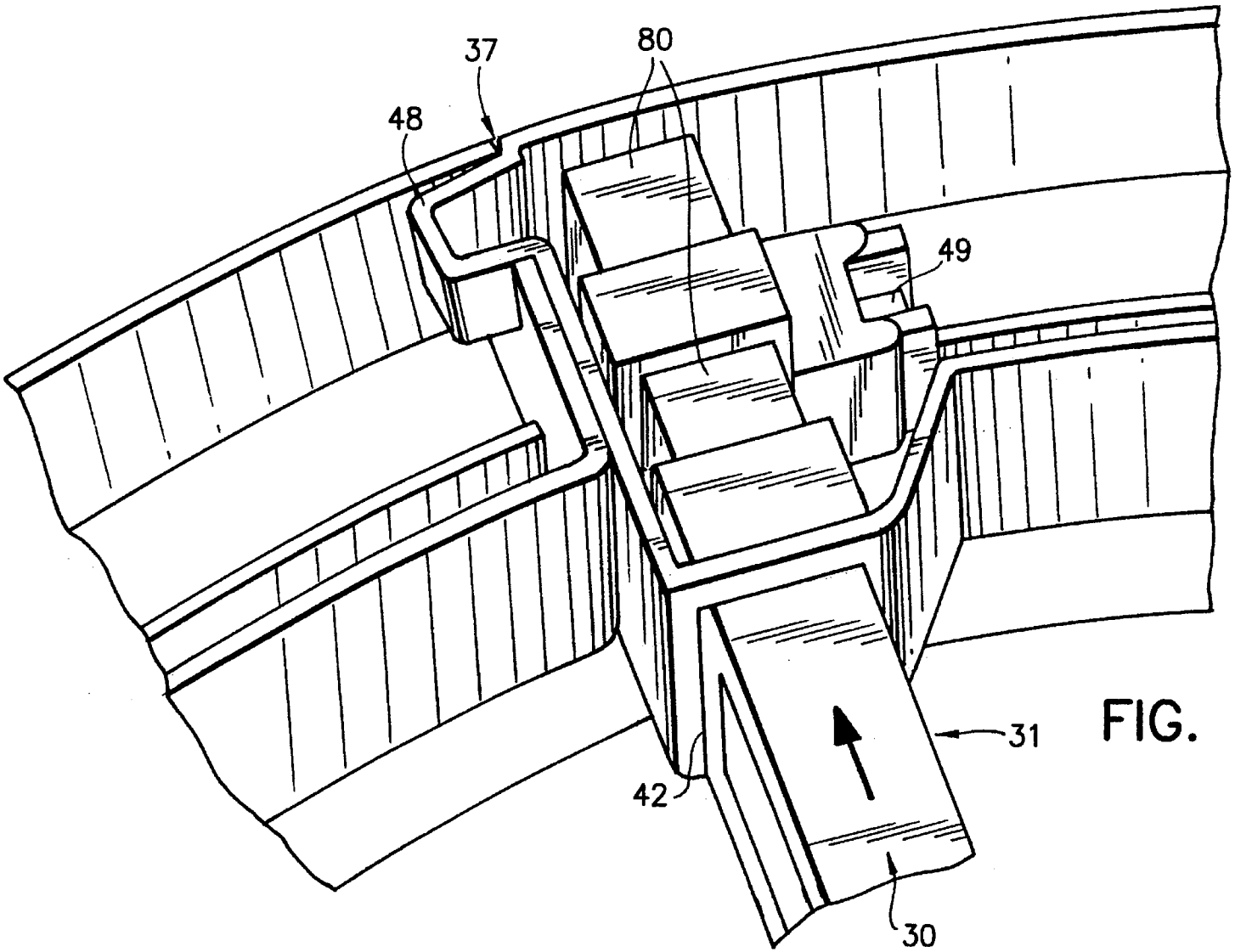
FIG. 8 is a fragmentary perspective view from underneath of the joint area between two monorail track segments showing the position of a male connector on the outer end of a bracing arm fitting into an aperture at the junction of two monorail track segments further showing the completed interlocking mechanism according an embodiment of the present invention.

Referring now to FIG. 8, the male connector 80 slides through female connector 42, and under notch 35 (FIGS. 5 and 7). The male connector 80 thus fixedly locks the left and right ends in position to provide a stable connection.

Figure 9:
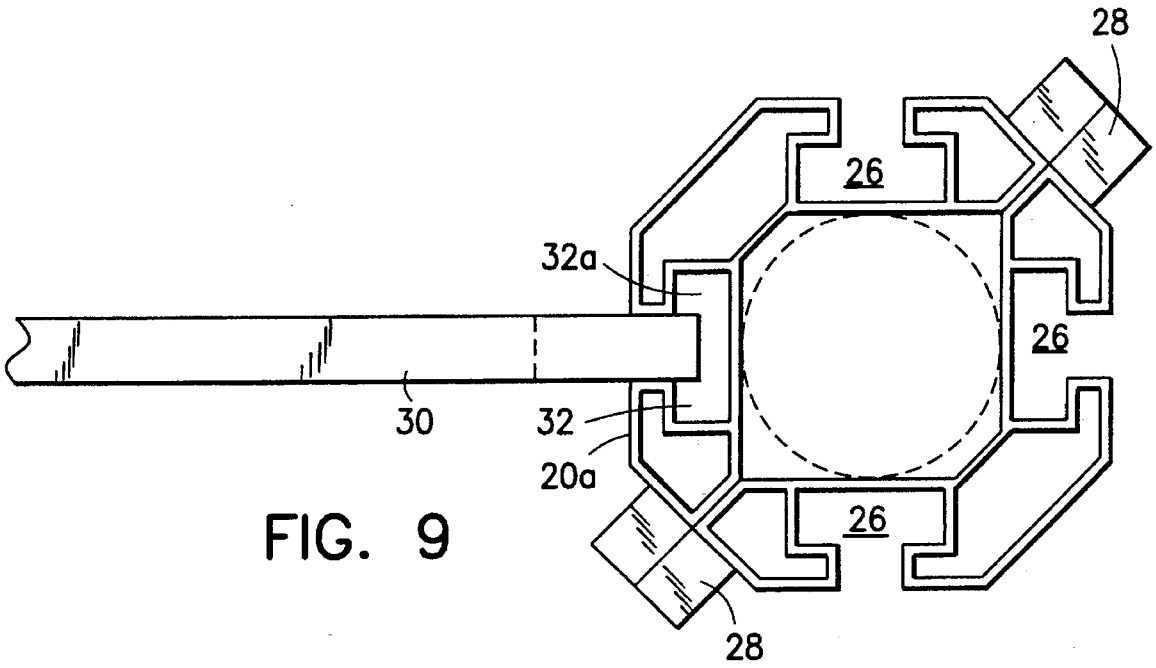
FIG. 9 is a fragmentary cross-sectional top view showing the positioning of a second end of the bracing arm in the corresponding recess on the hexagonal clamp according to an embodiment of the present invention.
Figure 9A:
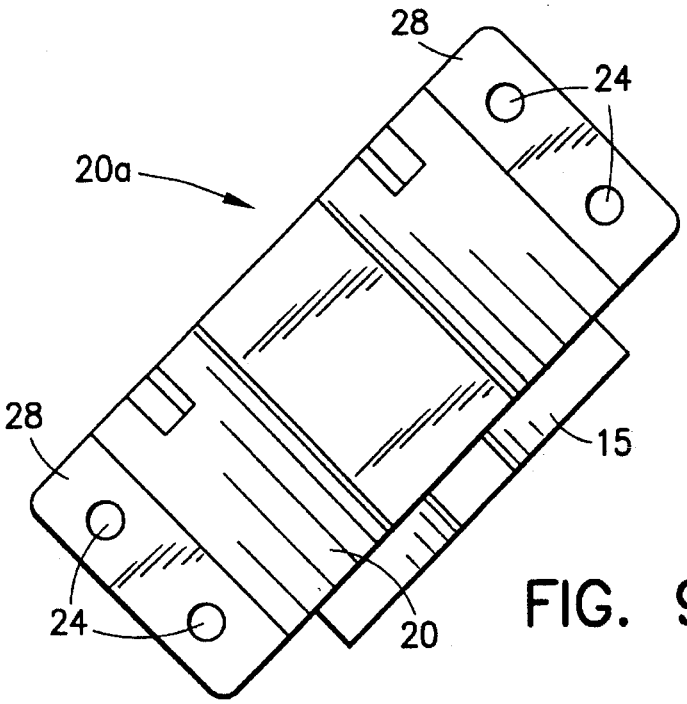
FIG. 9*a* is a projected elevation view of the hexagonal clamp according to an embodiment of the present invention.

Referring now to FIG. 9, the lateral protrusions 32 and **32*a* of bracing arm 30 are shown engaged in T-shaped recess 26. Flaps 28 are perpendicular to the vertical member, or tree trunk 29** shown in this figure, and run vertically when mounted.

Referring now to FIG. **9*a*, each piece of half-clamp 20, used to form hexagonal clamp 20*a*, has two T-shaped recesses 26 and ridge 15**.

Figure 10:
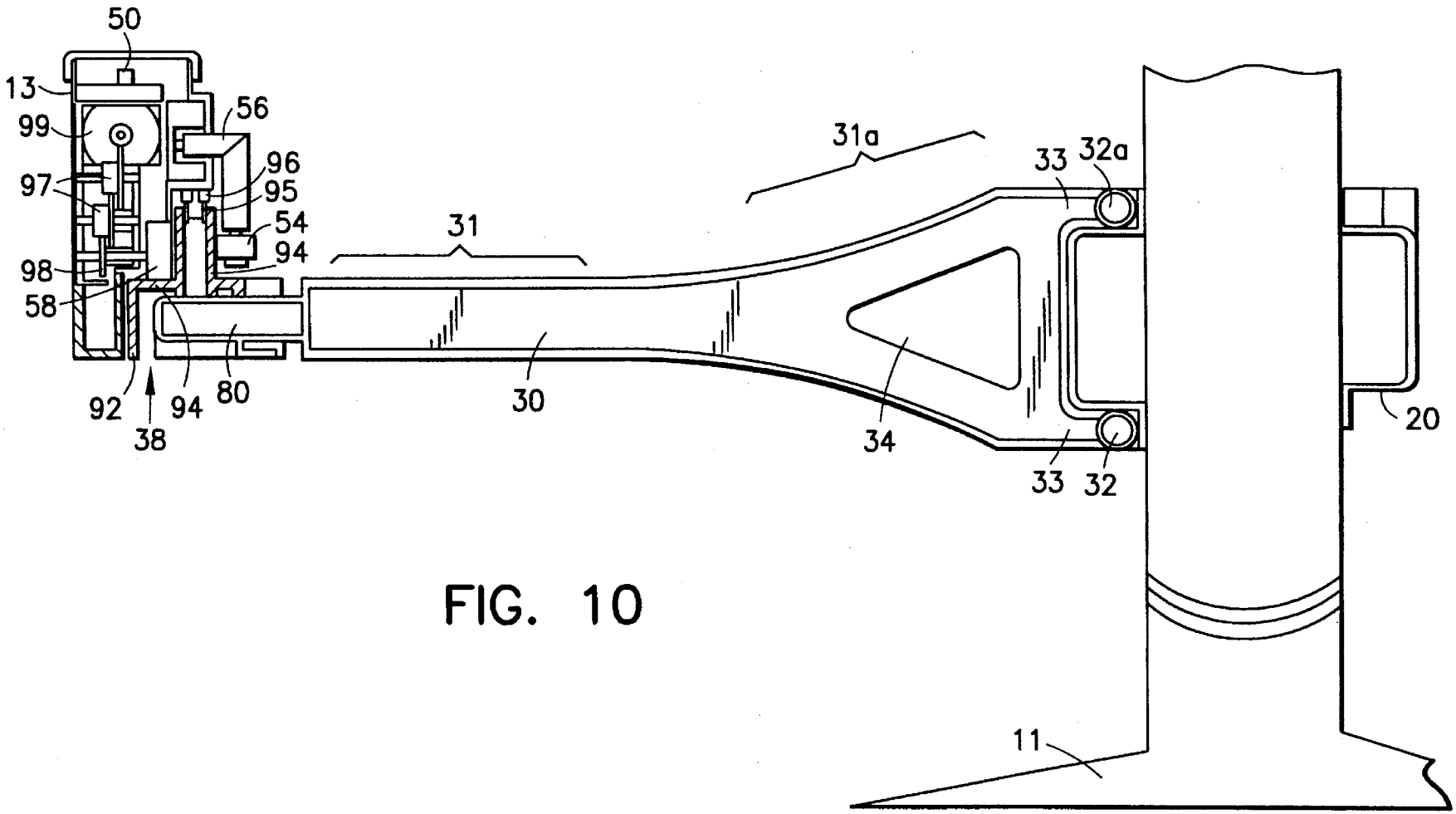
FIG. 10 is a cross-sectional side view showing a shuttle craft resting on the monorail track and the positioning of a bracing arm connecting the monorail track to a hexagonal clamp with an attached foot according an embodiment of the present invention.
Figure 12:
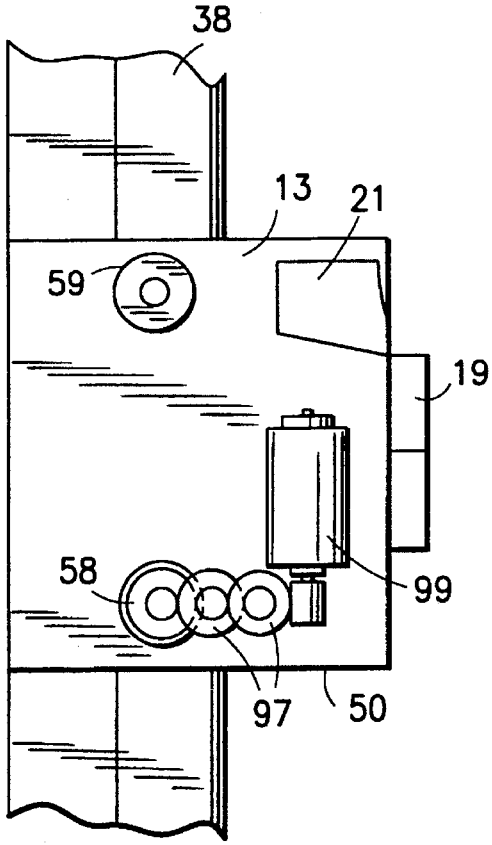
FIG. 12 is a fragmentary cross-sectional view of a shuttle craft mounted on the monorail track according the present invention.

Referring now to FIG. 10, power from an on board electric motor 99 is transmitted to single drive wheel 58 through a series of reduction gears 97. An idler wheel 59 (as shown in FIG. 12), supports an opposed end of shuttle craft 13. The shuttle craft 13 is housed within a metal or plastic chassis 50. Shuttle craft 13 is fitted over the vertical rise 44 of the monorail track 40 supported by drive wheel 58 and idler wheel 59. (as shown in FIG, 12).

A pair of guide bars 56 extend from chassis 50 behind vertical rise 44. Each guide bar 56 has a guide wheel 54, at its terminal end, rolling against the rear surface of vertical rise 44. The guide wheels 54 keep the shuttle craft 13 from pitching forward, and thereby prevent the shuttle craft 13 from becoming disengaged from monorail track 40.

A pair of resilient metal contact plates 96 extend downward from the chassis 50 toward the vertical rise 44 of the monorail track 40. A pair of metal wires 95 are embedded along the upper surface of monorail track 40 in a position contacted by contact plates 96. Electric power, which may be DC or AC power, is applied to metal wires 95. The metal contact plates 96 pick up the electric power from metal wires 95 to apply the electric power to the onboard electric motor 99.

The chassis 50 straddles the vertical extension 44 of the track segment 38 with the guide bars 56 against the inner side of the vertical rise 44 and the main body of the chassis 50 riding on the track 40.

The upper surface of an outer T-Crossing 94 is coated with materials creating a slightly rough surface so as to generate adequate (but not excessive) friction with the drive wheel 58 to assist movement. The rough surface may be created by, for example, a layer of sandpaper, or by a dimpled or roughened molded-in texture.

Referring now to FIG. 12, power from the on board electric motor 99 is transmitted to drive wheel 58 through a series of gears 97. Drive wheel 58 has a rubber tire or other friction coating to propel the chassis along the track.

Figure 11:
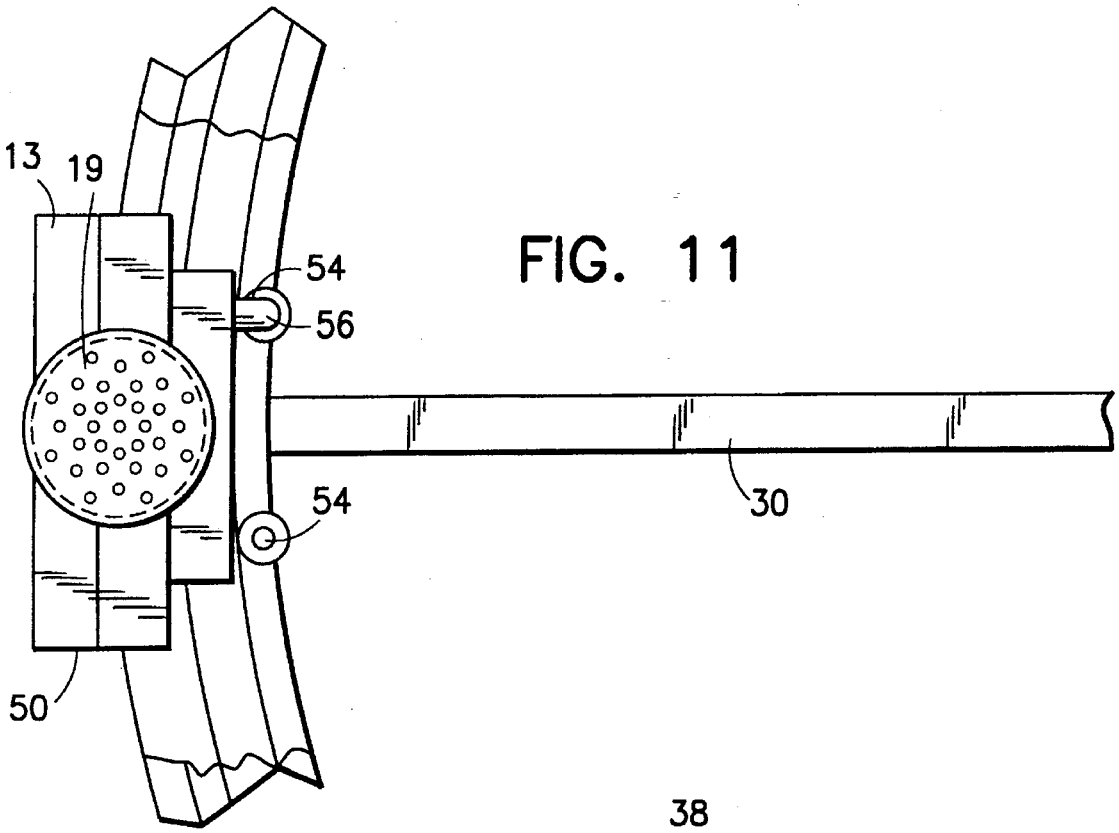
FIG. 11 is a fragmentary top view of a shuttle craft resting on the monorail track and the positioning of a bracing arm according an embodiment of the present invention.

Referring to FIG. 11, a speaker 19 is shown which plays music in conjunction with a read only memory (ROM), located within the chassis 50 of the shuttle craft 13. The speaker plays music selected from, for example, one of eighteen seasonal tunes. In conjunction with a light controller 21 (as shown in FIG. 12), the music operates synchronously with the plurality of lights actuated by the light controller located within the shuttle craft 13. In other embodiments contemplated by the present invention, the music operates independently of the plurality of lights.

Figure 13:
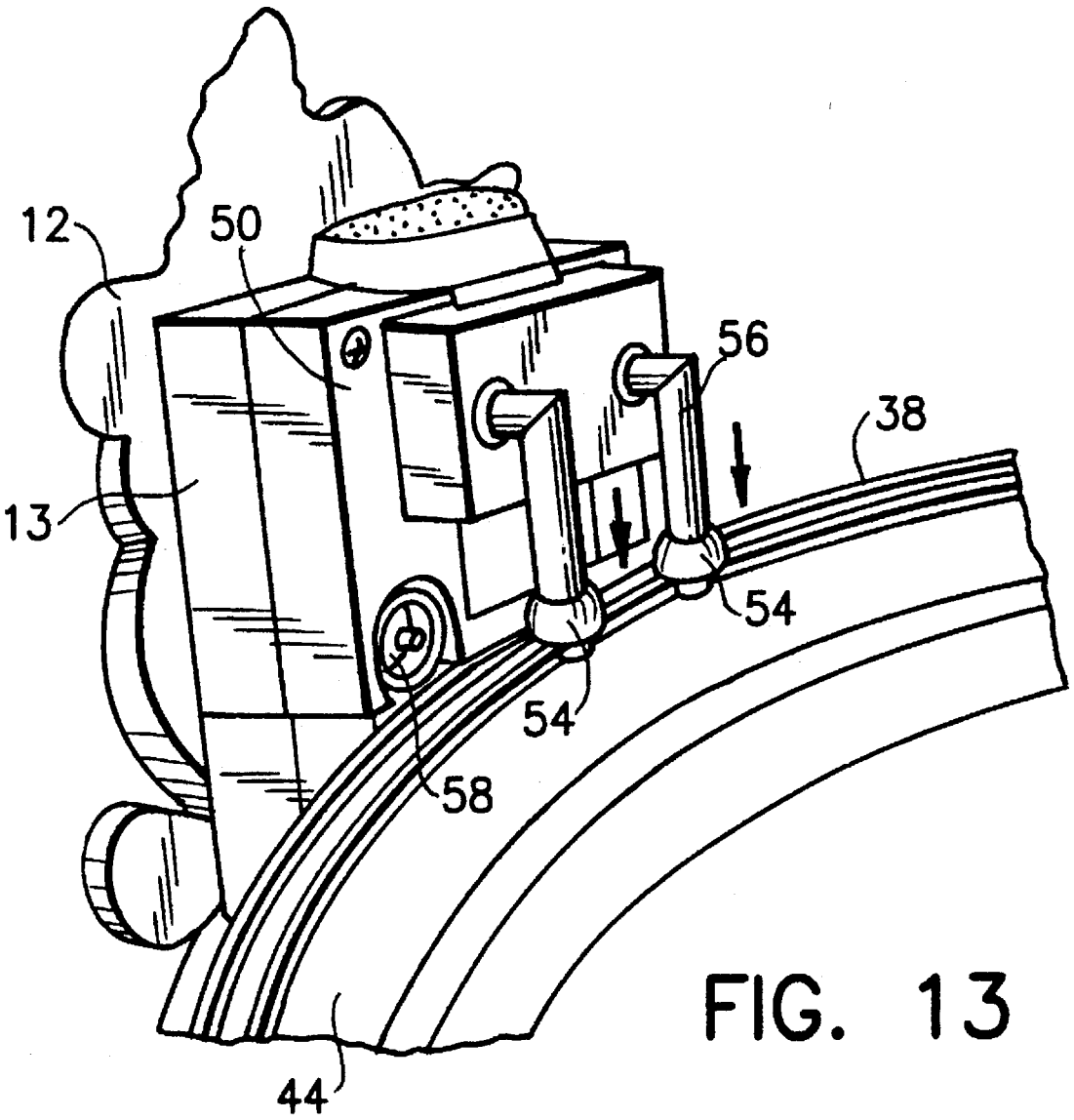
FIG. 13 is a fragmentary perspective view of a chassis with a figurine coupled thereto as it is readily attached to a monorail track according the present invention.

Referring now to FIG. 13, the shuttle craft 13 is housed within chassis 50. Vertical guide bars 56 are attached to an inner side of chassis 50. The guide bars 56 counteract the unbalanced mass of shuttle craft 13 to prevent shuttle craft 13 from tilting off monorail track 40. The guide bar 56 attachment point extends rearward from the body of chassis 50 to provide a gap between the guide bars 56 and the main body of the chassis 50. The gap accommodates the vertical rise 44 of the monorail 40.

Vertical rise 44 of segment 38 of the monorail track 40, engages drive wheel 58, and guide wheels 54 to ensure continued operation and to prevent derailment of shuttle craft 13.

The figurine 12 may be any seasonal, or other, motif such as, for example, a Christmas motif. Figurine 12 is fixedly mounted on an outer side of the chassis 50.

The above-described embodiment of the invention is shown in the environment of a tree, or other vertical member, about which clamp **20*a* is affixed. The invention should not be considered to be limited to such an embodiment. For example, support legs may be provided with clamp 20*a* for supporting the apparatus on any surface, without requiring a vertical member to be clamped within clamp 20*a*. The described embodiment employs a generally planar figurine on a single side of the shuttle craft 13. This could be considered to be satisfactory when the invention is employed on a Christmas tree where the rear side of the shuttle craft 13 is hidden. However, when the rear side of the shuttle craft 13 may be visible, a more three-dimensional motif may be desired for affixation to the shuttle craft 13**.

Having described preferred embodiments of the invention with reference to the accompanying figures, it is to be understood that the invention is not limited to those precise embodiments, and that various changes and modifications may be effected therein by one skilled in the art without departing from the scope or spirit of the invention as defined in the appended claims.

What is claimed is:

1. Apparatus comprising:

at least one toy shuttle craft;

a monorail track including at least four segments;

each segment having first and second pegs and first and second slots;

said first peg extending outward from a first end of said segment;

said second peg extending outward from a second end of said segment;

said first slot extending inward from said first end;

said second slot extending inward from said second end;

said first peg being fittable in said first slot of an other segment and said second peg being fittable in said second slot of said other segment thereby forming a joint having an opening;

said at least four segments being interconnected by said first and second pegs and first and second slots end to end to describe a circle;

means on said monorail track for detachably supporting said at least one toy shuttle craft;

a clamp;

said clamp including identical first and second pieces, each of said pieces including first and second flaps;

said first and second flaps being fittable together to draw said first and second pieces together into clamping relationship;

a base, capable of being detachably mounted between said first and second pieces of said clamp, which base is effective for supporting said monorail track at a distance above a surface;.

at least one bracing arm having first and second connectors;

said first connector being connected to said clamp;

said second connector being inserted into said opening;

said second connector retaining said first and second pegs and first and second slots in engagement, whereby secure assembly of said at least four segments is attained;

said monorail track including a vertical rise;

said shuttle craft including a plurality of guide bars;

at least one driven wheel on said shuttle craft;

means on said monorail track for engaging said at least one driven wheel;

said at least one driven wheel being fittable on a first side of said vertical rise;

at least one guide wheel on said shuttle craft; and said at least one guide wheel engaging a vertical portion of said vertical rise, whereby said shuttle craft is prevented from tilting off said monorail track.

2. Apparatus according to claim 1, wherein:

said at least one guide wheel is affixed to at least one guide bar; and said at least one guide bar extends from said shuttle craft to create a gap between itself and said shuttle craft for embracing said vertical rise.

3. Apparatus according to claim 1, wherein said at least one driven wheel includes a frictional coating effective for propelling said shuttle craft along said monorail track.

4. Apparatus according to claim 1, wherein said shuttle craft further includes:

means for generating a sound; and said means for generating a sound being actuated when said shuttle craft receives power.

5. Apparatus according to claim 1, wherein said shuttle craft further includes:

a plurality of light sources; and means for energizing said plurality of light sources in a pattern.

6. Apparatus comprising:

at least one toy shuttle craft;

a monorail track;

means on said monorail track for detachably supporting said at least one toy shuttle craft;

a clamp;

said clamp including means for grasping a generally vertical member;

at least two support legs;

means for affixing inner ends of said at least two support legs to said clamp;

said track including at least first and second segments;

engagement means at each end of each of said at least first and second segments for engaging cooperating means at mating ends of neighboring ones of said at least first and second segments;

said at least first and second segments defining a joint having an opening;

said at least two support legs each including an outer end;

said outer ends being fittable into said opening;

said engagement means including locking means cooperating with said outer ends to lock said at least first and second segments together and to support said monorail track;

said monorail track including a vertical rise;

said shuttle craft including a plurality of guide bars;

at least one driven wheel on said shuttle craft;

means on said monorail track for engaging said at least one driven wheel;

said at least one driven wheel being fittable on a first side of said vertical rise;

at least one guide wheel on said shuttle craft; and said at least one guide wheel engaging a vertical portion of said vertical rise, whereby said shuttle craft is prevented from tilting off said monorail track.

7. A toy monorail system with support apparatus comprising:

at least one shuttle craft;

a monorail track defining an endless travel path;

said track further comprising at least four segments joined end to end without a separate connector;

a clamp having four apertures for fittingly engaging a first end of four one-piece bracing arms, which bracing arms matingly engage, at a second end, with the joints formed between each of said at least four segments, whereby said at least four segments are locked together and said monorail track is supported at a distance above a surface;

means for mounting said shuttle craft detachedly upon said monorail;

said shuttle craft including power drive means for driving said shuttle craft along said monorail track; and said at least one shuttle craft chassis including means for generating sound and means for generating pulses of light.

8. The toy monorail system with support apparatus according to claim 7, wherein said at least one shuttle craft chassis has a figurine fixedly attached thereto.

9. A toy monorail system with support apparatus comprising:

at least one shuttle craft;

a monorail track defining an endless travel path;

said track further comprising at least four segments joined end to end without a separate connector;

a clamp having four apertures for fittingly engaging a first end of four one-piece bracing arms, which bracing arms matingly engage, at a second end, with the joints formed between each of said at least four segments, whereby said at least four segments are locked together and said monorail track is supported at a distance above a surface;

means for mounting said shuttle craft detachedly upon said monorail;

said shuttle craft including power drive means for driving said shuttle craft along said monorail track; and said at least one shuttle craft chassis having a figurine fixedly attached thereto.

* * * * *